United States Patent [19]

Sakano et al.

[11] Patent Number: 5,010,664

[45] Date of Patent: Apr. 30, 1991

[54] STEAM IRON HAVING A SOLLENOID DRIVEN PUMP AND HEATED EVAPORATION CHAMBER FOR PROVIDING STEAM AND OPERABLE FOR FURTHER PROVIDING EXTRA STEAM AT SPECIFIED INTERVALS

[75] Inventors: Chikashi Sakano, Yao; Seiichi Nakada, Sanda; Masao Shimizu, Nishinomiya; Shinichi Ito, Kobe; Toshiyoshi Yamamoto, Ibaraki, all of Japan

[73] Assignee: Matsushita Electric Industrial Co., Ltd., Osaka, Japan

[21] Appl. No.: 438,387

[22] Filed: Nov. 16, 1989

[30] Foreign Application Priority Data

Nov. 18, 1988 [JP] Japan ..... 63-292708
Nov. 18, 1988 [JP] Japan ..... 63-292710
Nov. 18, 1988 [JP] Japan ..... 63-292736

[51] Int. Cl.[5] ..... D06F 75/00; D06F 75/10; D06F 75/14; D06F 75/20

[52] U.S. Cl. ..... 38/77.7; 38/74; 38/77.5; 38/77.8; 38/77.9; 38/1 D

[58] Field of Search ..... 38/1 C, 1 D, 77.5, 77.6, 38/77.7, 77.8, 77.81, 77.82, 77.83, 77.9, 85, 74, 77.1

[56] References Cited

U.S. PATENT DOCUMENTS 2,770,896 11/1956 Holmberg ..... 38/78
2,817,169 12/1957 Schott ..... 38/77.1
3,599,357 8/1971 Gronwick ..... 38/77.5
4,616,122 10/1986 Burian ..... 38/77.8 X
4,656,763 4/1987 Kawasaki et al. ..... 38/77.83
4,686,352 8/1987 Nawrot et al. ..... 38/82

FOREIGN PATENT DOCUMENTS 2720124 11/1978 Fed. Rep. of Germany ..... 38/77.7
2391309 1/1979 France ..... 38/77.7
0247931 7/1987 German Democratic Rep. ..... 38/77.1
55-34957 8/1980 Japan .
0171095 9/1985 Japan ..... 38/77.1
1288900 12/1986 Japan ..... 38/77.83
62-16799 1/1987 Japan ..... 38/77.7
2026099 2/1987 Japan ..... 38/77.1
2142597 6/1987 Japan ..... 38/77.7
2298399 12/1987 Japan ..... 38/77.7

*Primary Examiner*—Werner H. Schroeder
*Assistant Examiner*—Ismael Izaguirre
*Attorney, Agent, or Firm*—Panitch Schwartz Jacobs & Nadel

[57] ABSTRACT

A steam iron having a soleplate to be heated by a heater, an evaporation chamber disposed upon the soleplate, a tank located above the evaporation chamber, and a pump which delivers water from the tank to the evaporation chamber, wherein the pump is driven at specified intervals so as to generate extra steam, to attain an improvement of manipulation of the steam iron in ejecting extra steam and preventing blow-off of hot water.

9 Claims, 3 Drawing Sheets

STEAM IRON HAVING A SOLLENOID DRIVEN PUMP AND HEATED EVAPORATION CHAMBER FOR PROVIDING STEAM AND OPERABLE FOR FURTHER PROVIDING EXTRA STEAM AT SPECIFIED INTERVALS

BACKGROUND OF THE INVENTION

1. Field of the Invention

This invention relates to a steam iron that performs the ironing of clothes.

2. Description of the Prior Art

In conventional steam irons, water stored in a tank is supplied to an evaporation chamber where it is evaporated and discharged through an ironing surface. Water is supplied by dripping it from a nozzle at a limited rate so that the water is evaporated instantaneously as it is supplied to the evaporation chamber. A steam jet is started and stopped by opening and closing the nozzle, respectively.

Various types of steam irons that generate a momentary surge of steam in order to increase a fabric ironing effect have been proposed, typical examples of which are disclosed in U.S. Pat. No. 3,599,357 and U.S. Pat. No. 4,656,763, in which a pumping means is disposed to supply water from a tank to an evaporation chamber. The pumping means is provided with a cylinder which sucks up water from the tank and discharges it into the evaporation chamber and a piston which moves reciprocally in the cylinder. By repeating the manual vertical operation of a control button which controls the operation of the piston, water is forcibly supplied to the evaporation chamber temporarily in a larger quantity than is usually dripped at a limited rate, thereby spouting extra steam.

However, in such a conventional construction as described above, it is difficult to operate in an extra steam mode while a switching operation between steam and dry operation modes is being performed during ironing.

Ironing operation requires, in addition to well-balanced manual operation of horizontal iron movement and pressing down the iron for the pressing of the clothes, pressing down the control button which projects out of the handle against the spring force, when using the extra steam mode. Thus in addition to the strong pressing force required for the ironing operation, the operator must repeat vertical operation of the control button with a large stroke. This means that a great load is imposed on the hand and fingers, so that manipulation of the iron becomes poor.

Moreover, since these operations are performed at the discretion of the operator during ironing and the intervals and the speed of the operation are not constant the amount of spouted steam varies. And a supply of water in a quantity that exceeds the capability of the evaporation chamber to instantaneously evaporate the water causes a dangerous spout of hot water that has not been evaporated.

Furthermore, since the amount of spouted steam required for the finish of ironing varies depending upon the kinds of fabric to be ironed, and the operator controls the quantity of steam spouted at the discretion thereof by adjusting the interval and speed of the operation of the control button, it is very difficult to feed a stable supply of steam to the fabric, so that a good finish cannot be expected.

SUMMARY OF THE INVENTION

The steam iron of this invention, which overcomes the above-discussed and numerous other disadvantages and deficiencies of the prior art, comprises a soleplate to be heated by a heater, an evaporation chamber disposed upon the soleplate, a tank located above the evaporation chamber, and an electric drive means which delivers water from the tank to the evaporation chamber, wherein said electric drive means is driven at specified intervals so as to generate extra steam.

In a preferred embodiment, the operation of said electric drive means is continued at specified intervals by a driving operation of the electric drive means.

In a preferred embodiment, the electric drive means stops the operation thereof after it operates a specified number of cycles or for a specified period of time by said driving operation of said electric drive means.

In a preferred embodiment, the operation of said electric drive means is continued at specified intervals during a period of time when a switch which effects the operation of the electric drive means is kept in the "on" position.

In a preferred embodiment, the electric drive means is composed of an electrically driven pump which utilizes an electromagnetic solenoid.

In a preferred embodiment, a pumping means is communicatively installed in a water guide path which supplies water from said tank to said evaporation chamber, and said pumping means is driven by said electric drive means.

In a preferred embodiment, the ejection of steam and the stoppage of steam ejection and the generation of extra steam are regulated by said electric drive means.

In a preferred embodiment, a pumping means is communicatively installed in a water guide path which supplies water from said tank to said evaporation chamber, a piston of said pumping means and an electromagnetic solenoid which drives said pumping means being incorporated into one body.

In a preferred embodiment, the driving interval or the driving period of time of said electric drive means is changed by means of a switching means.

Thus, the invention described herein makes possible the objectives of (1) providing a steam iron that attains an improvement of manipulation thereof in ejecting extra steam by providing an electric drive means as a means for delivering water from a tank to an evaporation chamber and driving the electric drive means at specified intervals; (2) providing a steam iron that prevents blow-off of hot water by stabilizing the driving interval of the electric drive means, thereby attaining a safe operation of the steam iron; (3) providing a steam iron that achieves an improvement of manipulation thereof by controlling the ejection of steam and the stoppage of steam ejection and the generation of extra steam by the use of the electric drive means; and (4) providing a steam iron that attains stable supply of steam ejection in a quantity required for the better ironing of the finish of the fabric being ironed.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

EXAMPLE 1

Figure 1:
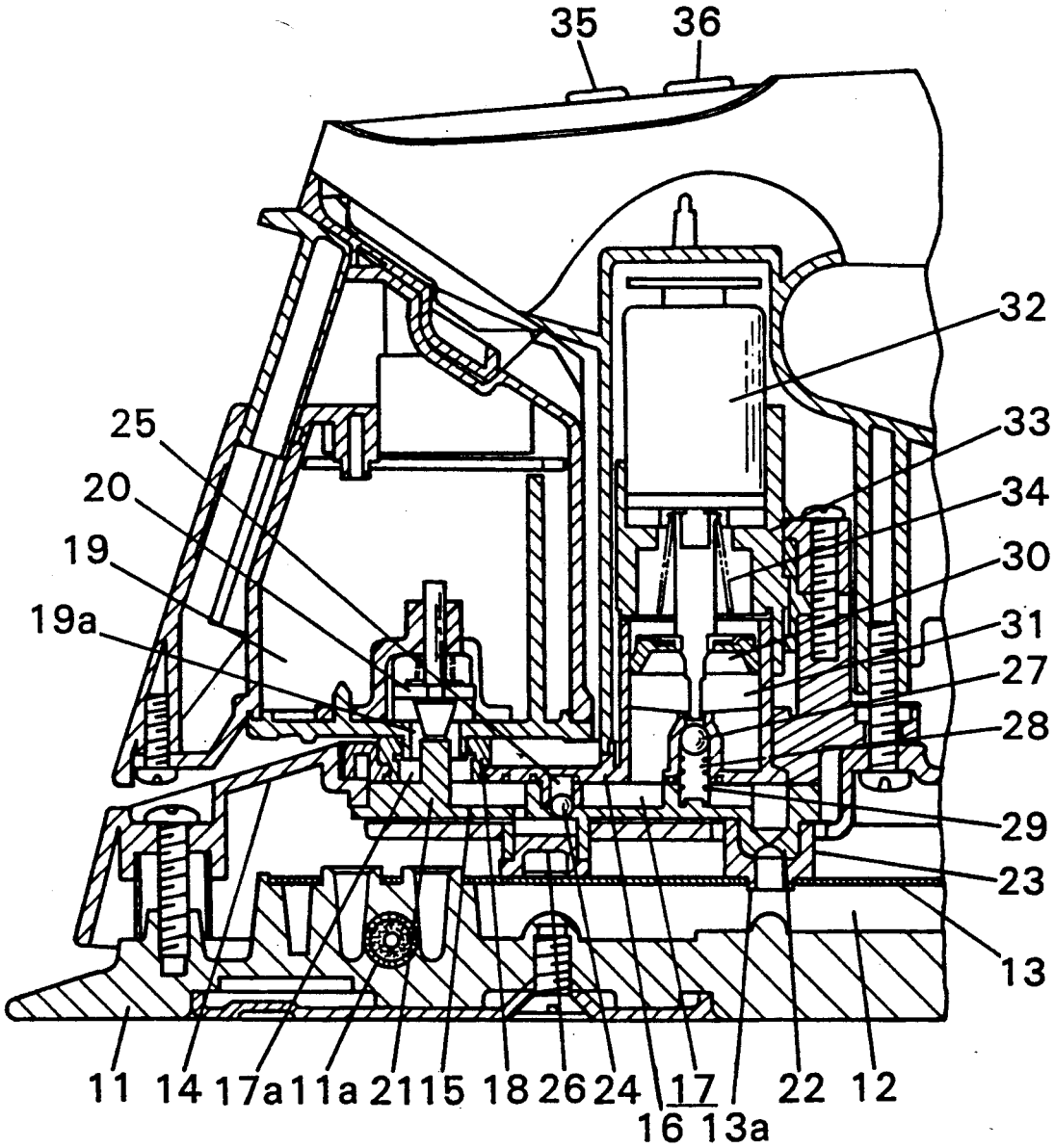
FIG. 1 is a sectional view showing the main portion of a steam iron of this invention.

FIG. 1 shows a steam iron of the invention, which comprises a soleplate 11 that is provided with a heater 11*a*, an evaporation chamber 12 that is incorporated into the soleplate 11 as a single body, a detachable tank 19 that is located above the evaporation chamber 12, and an electric drive means 32 that delivers water from the tank 19 to the evaporation chamber 12.

The evaporation chamber 12 is covered with a lid 13. A heat insulator plate 14 is located above the soleplate 11. Reference numerals 15 and 16 are water guide bodies, respectively, which are bonded together by thermal adhesion or the like to form a water guide channel 17. An elastic joint packing 18 is provided around an inlet 17*a* of the water guide channel 17. The top face of the joint packing 18 is put into close contact with a tank outlet 19*a* which is provided at the bottom of the tank 19 to connect the tank 19 with the water guide channel 17. A normally-closed valve 20 normally closes the tank outlet 19*a* at the bottom of the tank 19. When the detachable tank 19 is installed into the body of the steam iron, the valve 20 is opened by a lifter 21 which is composed of a part of the water guide body 16 to cause the water in the tank 19 to flow into the water guide channel 17. A drip nozzle 22 is provided at the outlet of the water guide channel 17 and communicates with the water guide channel 17 and the evaporation chamber 12 via a nozzle packing 23 and an opening 13*a* of the evaporation chamber lid 13. A ball valve 24 is provided freely movably in a cavity 25 which forms a part of the water guide channel 17 of the water guide body 15. A plug 26 is provided at the bottom face of the water guide body 16 and is used to form the water guide channel 17. Another ball valve 27 is set by means of an energizing spring 29 in the cavity 28 which forms a part of the water guide channel 17 of the water guide body 15, and is arranged to oppose the lower end of a pumping means 30. The pumping means 30 is incorporated in a cylinder 31 which is formed in the water guide channel 17.

The electric drive means 32 is constituted of an electromagnetic solenoid or the like provided above the pumping means 30, and is made in a single body with the cylinder 31 by means of an electric drive means support 33. When an electric current is not flowing in the electric drive means 32, a spring 34 forces the pumping means 30 upward. When a current flows, the electric drive means 32 surpasses the force of the spring 34 to press the pumping means 30 downward, thereby opening or closing the water guide channel 17 by means of the ball valve 27.

In such a construction, water from the tank 19 passes the joint packing 18 to enter into the inlet 17*a* of the water guide channel 17, and moves the ball valve 24 with pressure so as to enter into the cylinder 31 which is formed by a part of the water guide body 15. When electric current passes through the electric drive means 32, the lower end of the pumping means 30 presses down the ball valve 27, causing the water to pass the ball valve 27 and the drip nozzle 22 and flow into the evaporation chamber 12.

The operation of the pumping means 30 is explained in the following. Usually, when current does not flow in the electric drive means 32, because the spring 34 forces the pumping means 30 upward, the lower end of the pumping means 30 cannot press the ball valve 27 and therefore the ball valve 27 shuts off the water guide channel 17 to keep the iron in a dry mode.

Figure 2:
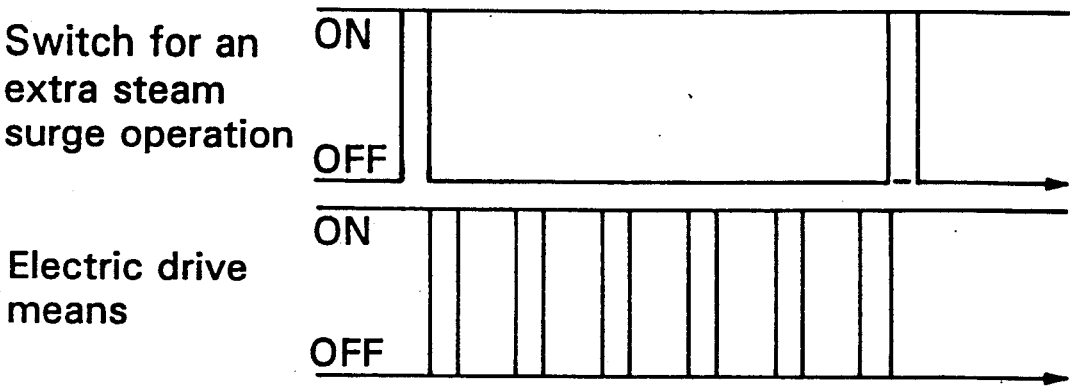
FIG. 2 is a timing chart showing the operating relationship between the steam button and the electrically driven water supplying means of the steam iron shown in FIG. 1.

Then, when a switch 35 is pressed to energize the electric drive means 32, the electric drive means 32 is energized to press down the pumping means 30 by surpassing the force of the spring 34, so that the lower end of the pumping means 30 presses the ball valve 27 downward. Consequently, the flow rate of the water from the tank 19 to the evaporation chamber 12 is regulated by the drip nozzle 22 due to its pressure as mentioned above, so that a normal quantity of steam is generated in the evaporation chamber 12. When a large quantity of steam is needed at a time, the steam iron is made in such a construction that energization of an electromagnetic solenoid is automatically turned on or off at specified intervals by means of an electronic circuit (not shown) when a switch 36 for the extra steam mode is pressed once, as shown in FIG. 2, for example. In such a construction, excitation and non-excitation of the electromagnetic solenoid are repeated cyclically, and the pumping means 30 repeats upward and downward movements, so that a large quantity of water can be supplied to the evaporation chamber 12 via the drip nozzle 22, resulting in an extra steam.

Moreover, when the switch 36 for extra steam surge operation is pressed, energization of the electromagnetic solenoid is locked in an on- or off-status, thereby stopping the spouting of extra steam. As mentioned above, extra steam can be spouted only by pressing the extra steam surge operation switch 36, and neither strong operating force nor force to press down the switch 36 is required, so that ease of operation can be greatly improved.

Moreover, the speed and interval of the steam ejection become independent of the operator in the case where the steam iron is constituted in such a way that the operation of the electric drive means 32 is turned on and off at a stable cycle by means of an electronic circuit or the like, and thus variation in the steam quantity is eliminated. In the case where the iron is made in such a construction as the cycle of turning on/off the electric drive means 32 is predetermined so that water is supplied in a quantity appropriate for the evaporation capacity of the evaporation chamber 12 provided in the soleplate 11, the problem of hot water ejecting from the soleplate 11 due to oversupply of water beyond the evaporation capacity of the evaporation chamber 12 is eliminated, thereby attaining an improvement in the safety of the ironing operation.

EXAMPLE 2

Figure 3:
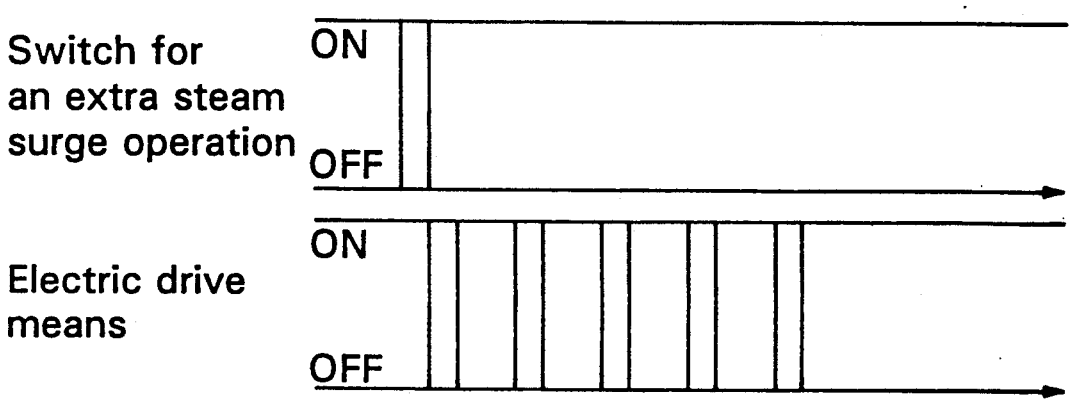
FIG. 3 is a timing chart showing the operating relationship between the steam button and the electrically driven water supplying means of another steam iron of this invention.

FIG. 3 is a timing chart illustration of another steam iron of this invention, wherein, when the extra steam surge operation switch described above is pressed, operation of the electric drive means 32 is turned on/off automatically by an electronic circuit or the like to have the electric drive means operate a specified number of cycles or for a specified period of time and then automatically stop in an on- or off-status. In this construction, the operation of pressing the extra steam surge operation switch once again is not required to stop the spouting of the extra steam, thereby attaining a further improvement of manipulation of the steam iron. Although an example of the electric drive means being turned on and off a plurality of times is shown in FIG. 3, it can be turned on/off only once or it can be stopped after operating for a specified period of time, but it is not regulated by a specified number of operation cycles. What is essential to this invention is that it is made in such a construction that, after the extra steam surge operation switch is pressed once, the electric drive means automatically stops, without requiring the extra steam surge operation switch to be pressed once again, to stop the extra steam ejection.

EXAMPLE 3

Figure 4:
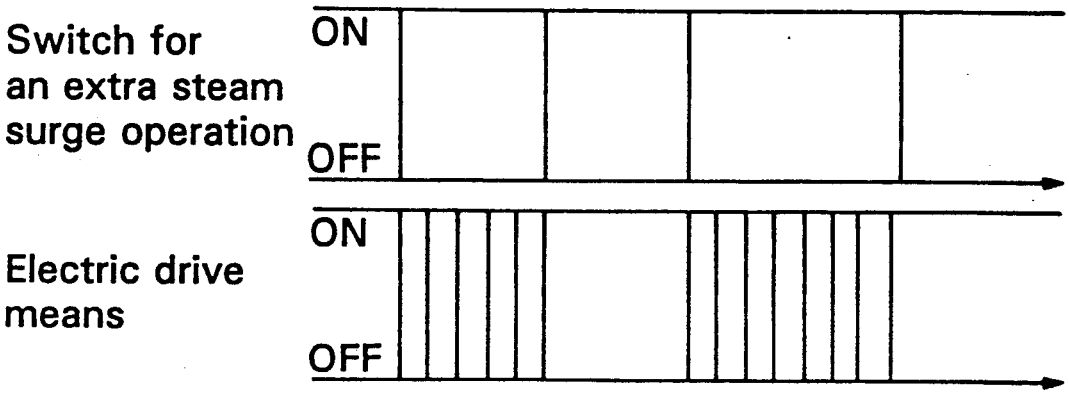
FIG. 4 is a timing chart showing the operating relationship between the steam button and the electrically driven water supplying means of still another steam iron of this invention.

FIG. 4 is a timing chart illustrating still another steam iron of this invention, wherein the operation of the electric drive means is automatically turned on and off by means of an electronic circuit or the like only when the steam surge operation switch is being pressed, and the operation of the electric drive means is locked in an on- or off-status when the steam surge operation switch is released. In this case, extra steam is supplied only when the operator needs it and therefore steam ejection is not in operation when it is not needed, thereby preventing wasteful use of water in the tank. Therefore the number of water supplies to the tank is reduced and the operating efficiency of ironing can be improved.

EXAMPLE 4

Figure 5:
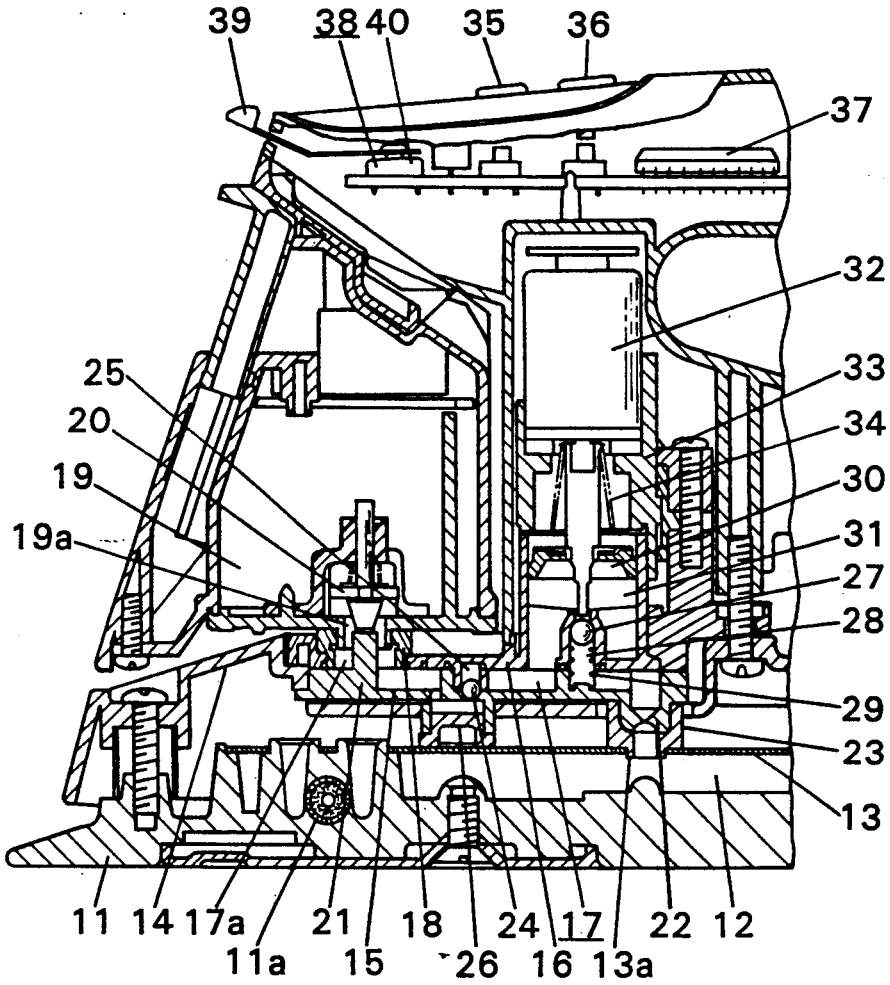
FIG. 5 is a sectional view showing the main portion of still another steam iron of this invention.
Figure 6:
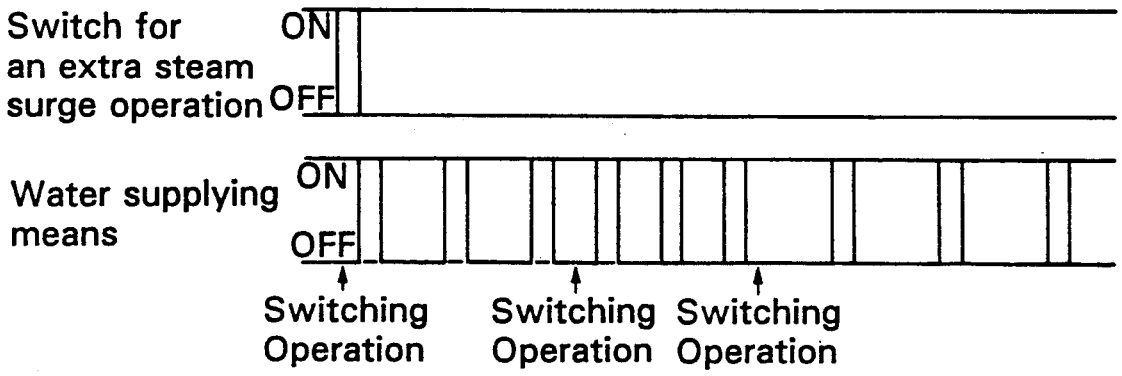
FIG. 6 is a timing chart showing the operating relationship between the steam button and the electrically driven water supplying means of still another steam iron of this invention.

FIG. 5 shows still another steam iron of this invention, wherein the driving interval or driving period of time of the electric drive means is changed by operating a steam switching means 38 which is constituted of a rotatable lever 39 and a variable resistor 40. The rotation angle of the lever 39 is output to the electronic circuit 37 as a variation in the resistance of the resistor 40.

The electronic circuit 37 controls energization of the electromagnetic solenoid in such a manner that the on/off interval of energization of the electromagnetic solenoid is changed depending upon the change in the resistance. Consequently extra steam can be obtained at arbitrary intervals by the operator properly operating the steam switching means 38. In this construction as described above, when ironing a fabric that requires a large quantity of steam like, for example, cotton, a large quantity of steam can be obtained simply by setting the steam switching means 38 in a position which gives extra steam at the shortest intervals and pressing the switch 36 for an extra steam surge operation, so that ironing can be performed with good finish. In the same way, the most effective steam quantity for the fabric to be ironed can be obtained by a simple operation of the steam switching means 38.

Although it is disclosed in the above-mentioned embodiment that the interval of turning on and off the energization of the electromagnetic solenoid is changed by means of the steam switching means, this invention is, of course, applicable to such a construction that the number of on/off cycles may instead be changed with a constant on/off interval or both the interval and the number of on/off cycles may be changed. In short, the steam iron of this embodiment has such a construction that the steam quantity can be changed by means of a steam switching means.

Moreover, although a pumping means which moves up and down is driven by an electromagnetic solenoid in the constructions of the above-mentioned examples, it may be made in such a construction that a motor and a diaphragm, or a spring and a cam or the like are combined. In short, a steam iron of this invention has such a construction that the electrically driven water supplying means can be driven at specified intervals.

According to the invention, as described above, an electrically driven water supplying means which supplies water from the tank to the evaporation chamber is driven at specified intervals, so that manipulation of the steam iron by which a steam ejection is achieved can be improved. Also, according to the invention, the quantity and interval of water supply for the generation of steam can be stabilized by controlling the interval of driving the electrically driven water supplying means by means of a timer means, so that water supply beyond the evaporation capacity of the evaporation chamber and blow-off of hot water from the soleplate can be prevented, resulting in a safer iron.

Furthermore, according to the invention, the operation of the electrically driven water supplying means is continued at specified intervals when a steam button which effects the operation of the electrically driven water supplying means is operated, and thus a successive steam ejection can be obtained without pressing the steam button every time when a steam ejection is desired, so that manipulation of the steam iron can be improved. Furthermore, a steam ejection can be achieved in a state where the soleplate is kept at a high temperature depending upon the operating pattern of the electrically driven water supplying means. Thus, wrinkles can be effectively ironed out, a wasteful use of water in the tank can be prevented, and the efficiency of the ironing operation can be improved.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A steam iron comprising a soleplate to be heated by a heater, a fluid evaporation chamber disposed upon the soleplate for generating steam therein, a tank located above the evaporation chamber, and an electric drive means for delivering water from the tank to the evaporation chamber, wherein said electric drive means is driven at specified intervals so as to generate extra steam.

2. A steam iron according to claim 1, wherein the operation of said electric drive means is continued at specified intervals by said driving operation of said electric drive means.

3. A steam iron according to claim 1, wherein said electric drive means stops the generation of extra steam after having operated a specified number of cycles or for a specified period of time by said driving operation of said electric drive means.

4. A steam iron according to claim 1, wherein the operation of said electric drive means is continued at specified intervals during a period of time by a switch for effecting the operation of the electric drive means being kept in an "on " position.

5. A steam iron according to claim 1, wherein said electric drive means is comprised of an electrically driven pump utilizing an electromagnetic solenoid.

6. A steam iron according to claim 1, wherein a pumping means is communicatively installed in a water guide path supplying water from said tank to said evaporation chamber, and said pumping means is driven by said electric drive means.

7. A steam iron according to claim 1, wherein the ejection of steam and an stoppage of steam ejection and the generation of extra steam are regulated by said electric drive means.

8. A steam iron according to claim 1, wherein a pumping means is communicatively installed in a water guide path supplying water from said tank to said evaporation chamber, a piston of said pumping means and an electromagnetic solenoid driving said pumping means being incorporated into one unit.

9. A steam iron according to claim 1, wherein the driving interval or the driving period of time of said electric drive means is changed by a switch.

* * * * *